US005695018A

United States Patent [19]

Pessier et al.

[11] Patent Number: 5,695,018

[45] Date of Patent: Dec. 9, 1997

[54] EARTH-BORING BIT WITH NEGATIVE OFFSET AND INVERTED GAGE CUTTING ELEMENTS

[75] Inventors: Rudolf Carl Otto Pessier; Matthew Ray Isbell, both of Houston, Tex.

[73] Assignee: Baker Hughes Incorporated, Houston, Tex.

[21] Appl. No.: 527,818

[22] Filed: Sep. 13, 1995

[51] Int. Cl.[6] ..... F21B 9/36

[52] U.S. Cl. ..... 175/331; 175/374; 175/353

[58] Field of Search ..... 175/331, 332, 175/353, 350, 333, 374, 371, 375

[56] References Cited

U.S. PATENT DOCUMENTS

| | | | |
|---|---|---|---|
| 930,759 | 8/1909 | Hughes . | |
| 1,263,802 | 4/1918 | Reed . | |
| 2,340,492 | 2/1944 | Scott . | |
| 2,463,932 | 3/1949 | Zublin . | |
| 2,571,930 | 10/1951 | Noble . | |
| 3,412,817 | 11/1968 | Reichmuth | 175/333 X |
| 3,495,668 | 2/1970 | Schumacher | 175/374 X |
| 3,696,876 | 10/1972 | Ott | 175/374 |
| 4,067,406 | 1/1978 | Garner et al. | 175/341 |
| 4,285,409 | 8/1981 | Allen | 175/336 |
| 4,657,093 | 4/1987 | Schumacher | 175/353 |
| 4,763,736 | 8/1988 | Varel, Sr. | 175/341 |
| 4,848,476 | 7/1989 | Deane et al. | 175/340 |
| 4,953,641 | 9/1990 | Pessier | 175/353 |
| 5,282,512 | 2/1994 | Besson et al. | 175/374 |
| 5,287,936 | 2/1994 | Grimes et al. | 175/331 |
| 5,407,022 | 4/1995 | Scott et al. | 175/331 |

FOREIGN PATENT DOCUMENTS

| | | | |
|---|---|---|---|
| 395 572A1 | 10/1990 | European Pat. Off. | E21B 10/08 |
| 1123637 | 2/1962 | Germany . | |
| 1223779 | 9/1966 | Germany . | |
| 473797 | 9/1975 | U.S.S.R. . | |
| 802502 | 2/1981 | U.S.S.R. . | |
| 0894170 | 1/1982 | U.S.S.R. | 175/332 |

*Primary Examiner*—Dennis L. Taylor
*Attorney, Agent, or Firm*—Robert A. Felsman; Mark D. Perdue

[57] ABSTRACT

An earth-boring bit has a bit body and at least one cantilevered bearing shaft depending inwardly and downwardly from the bit body. A cutter is mounted for rotation on the bearing shaft and includes a gage surface and an adjacent cutter backface. The cutter has negative offset with respect to the axis and direction of rotation of the bit. A plurality of cutting elements are arranged on the cutter including a plurality of gage cutting elements on the gage surface of the cutter. At least one of the gage cutting elements projects beyond the gage surface and defines a cutting surface facing the backface of the cutter for engaging the sidewall of the borehole being drilled as the gage cutting element moves up the sidewall.

12 Claims, 1 Drawing Sheet

Fig. 1
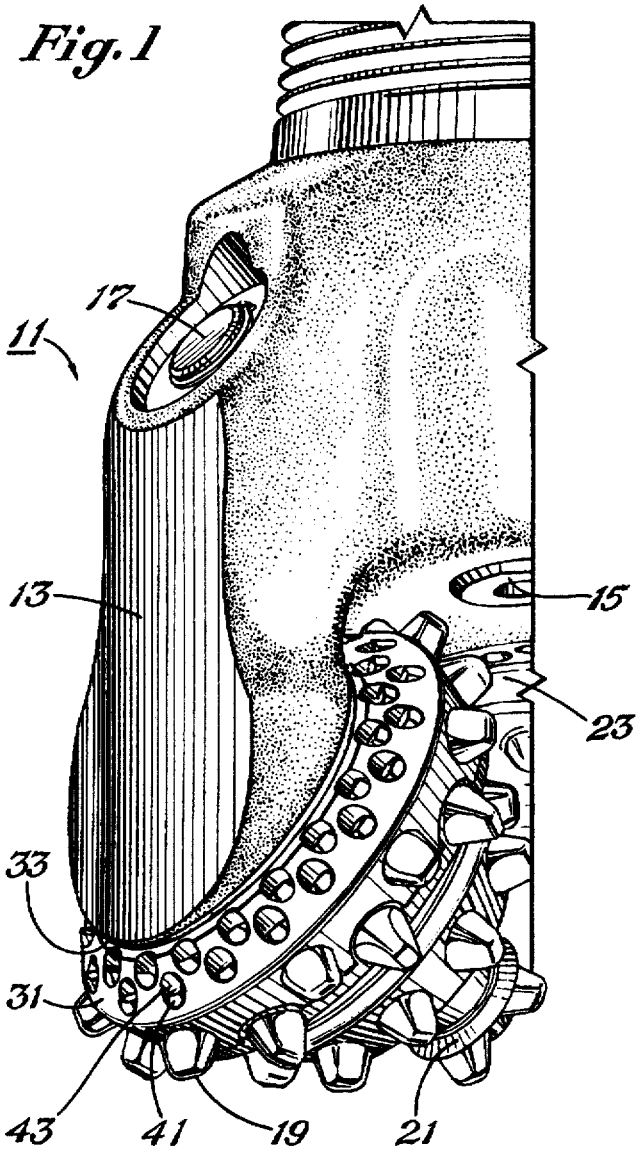
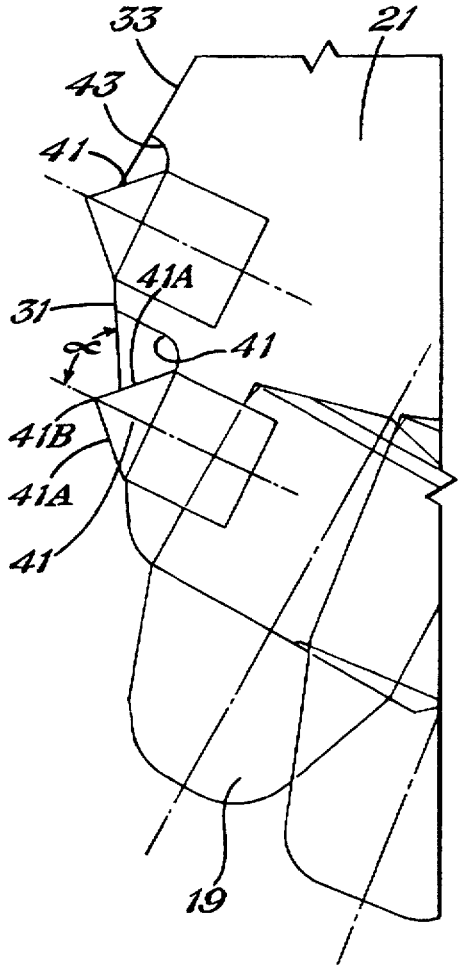
Fig. 4
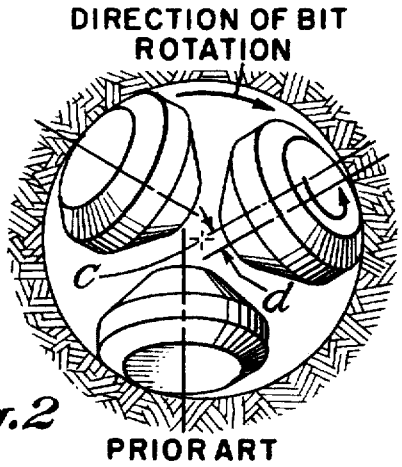
Fig. 2
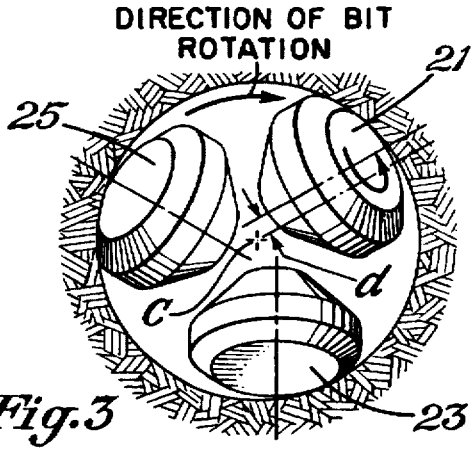
Fig. 3

EARTH-BORING BIT WITH NEGATIVE OFFSET AND INVERTED GAGE CUTTING ELEMENTS

BACKGROUND OF THE INVENTION

1. Field of the Invention

The present invention relates in general to earth-boring bits. The present invention relates more particularly to earth-boring bits of the rolling cutter variety.

2. Background Information

The success of rotary drilling enabled the discovery of deep oil and gas reservoirs. The rotary rock bit was an important invention that made rotary drilling economical.

Only soft earthen formations could be penetrated commercially with the earlier drag bit, but the two-cone rock bit, invented by Howard R. Hughes, U.S. Pat. No. 930,759, drilled the hard caprock at the Spindletop Field near Beaumont, Tex., with relative ease. That venerable invention, within the first decade of this century, could drill a scant fraction of the depth and speed of the modern rotary rock bit. If the original Hughes bit drilled for hours, the modern bit drills for days. Modern bits sometimes drill for thousands of feet instead of merely a few feet. Many advances have contributed to the impressive improvement of rotary rock bits.

In drilling boreholes in earthen formations by the rotary method, rock bits fitted with one, two, or three rolling cutters are employed. The bit is secured to the lower end of a drillstring that is rotated from the surface or by downhole motors or turbines. The cutters mounted on the bit roll and slide upon the bottom of the borehole as the drillstring is rotated, thereby engaging and disintegrating the formation material to be removed. The roller cutters are provided with teeth or cutting elements that are forced to penetrate and gouge the bottom of the borehole by weight from the drillstring. The cuttings from the bottom and sidewalls of the borehole are washed away by drilling fluid that is pumped down from the surface through the hollow, rotating drillstring and are carried in suspension in the drilling fluid to the surface.

The form and location of the cutting elements upon the cutters have been found to be extremely important to the successful operation of the bit. Certain aspects of the design of the cutters become particularly important if the bit is to penetrate deeply into a formation to effectively strain and induce failure in more plastically behaving rock formations such as shales, siltstones, and chalks.

It is a conventional practice with earth-boring bits of the rolling cutter variety to offset the cutters of the bit such that the rotational axis of each cutter is offset from and does not intersect the geometric center of the bit. Offset cutters do not engage in a pure rolling action on the bottom of the borehole, but slide and scrape, enhancing the ability of the cutting elements to induce strain in the formation material and increasing the rate of penetration. In most bits with offset cutters, the cutters are "positively" offset with respect to the geometric center and direction of rotation of the bit. In positive offset cutters, the rotational axis of each cutter is offset from the geometric center of the bit in the direction of rotation of the bit.

One difficulty encountered in drilling with earth-boring bits of the rolling cutter variety is known as "off-center" running and occurs when the bit engages in lateral movement and begins to rotate about a point other than its geometric center. Off-center running occurs frequently in drilling applications in which the material being drilled is behaving plastically and lateral movement of the bit is facilitated due to lack of stabilization, light depth of cut, high RPM, and low weight on bit. Another factor encouraging lateral movement of the bit is inadequate bottom hole cleaning, which leaves a layer of fine cuttings on the borehole bottom, which acts as a lubricant between the bit and formation material to make lateral displacement of the bit easier.

Cutters with positive offset have a tendency to roll and slide in a direction tangent to the diameter of the borehole and thus generate a force that tends to urge the bit into off-center running. The cutting elements on conventional roller cone bits are arranged in distinct rows on two or more cutters. The rows are not in the same radial position on each cutter to allow for intermesh of the cutting elements and maximum cutter and bearing diameter. When the bit is running on center, the rows of the cutting elements align to give full coverage across the borehole bottom profile.

In the off-center running mode, two or more rows of cutting elements align to give double coverage on some parts of the borehole bottom, leaving others without any cutting action. In this case, rings of uncut material form on the bottom, which have to be disintegrated by the smooth cutter shell surface rolling over it.

The off-center drilling mode with conventional cutting structures is thus highly inefficient and results in penetration rates that are a fraction of the on-center mode, for which the drill bit is designed. In addition, the relatively soft steel cutter shell is subject to accelerated wear, which can lead to accelerated cutting structure wear or failure in abrasive formations. Also, the inefficient drilling modes generates more heat, which has an adverse effect on bearing life.

A need exists, therefore, for earth-boring bits having improved ability to resist off-center running, rather than inducing it.

SUMMARY OF THE INVENTION

It is a general object of the present invention to provide an earth-boring bit of the rolling cutter variety with improved resistance to inefficient and harmful off-center running.

This and other objects, features and advantages of the present invention are accomplished by providing an earth-boring bit having a bit body and at least one cantilevered bearing shaft depending inwardly and downwardly from the bit body. A cutter is mounted for rotation on the bearing shaft and includes a gage surface and an adjacent cutter backface. The cutter has negative offset with respect to the axis and direction of rotation of the bit. A plurality of cutting elements are arranged on the cutter including a plurality of gage cutting elements on the gage surface of the cutter. At least one of the gage cutting elements projects beyond the gage surface and defines a cutting surface facing the backface of the cutter for engaging the sidewall of the borehole being drilled as the gage cutting element moves up the sidewall.

According to the preferred embodiment of the present invention, the cutting surface of the gage cutting element defines a negative rake angle with respect to the sidewall of the borehole.

According to the preferred embodiment of the present invention, the gage cutting element projecting beyond the gage surface is chisel-shaped and defines a crest and a longitudinal axis. The chisel-shaped element is tilted toward the cutter backface such that an acute angle of between 15 and 75 degrees is defined between the longitudinal axis and the gage surface.

DESCRIPTION OF THE DRAWINGS

FIG. 1 is a fragmentary perspective view of an earth-boring bit according to the present invention.

FIG. 2 is a schematic plan view of the cutters of a conventional or prior-art earth-boring bit, viewed from above.

FIG. 3 is a schematic plan view, similar to FIG. 2, depicting the cutters of the earth-boring according to the present invention, viewed from above.

FIG. 4 is a fragmentary section view of a portion of a cutter of the earth-boring bit according to the present invention.

DESCRIPTION OF THE PREFERRED EMBODIMENT

Referring now to the Figures, and particularly to FIG. 1, a portion of an earth-boring bit 11 according to the present invention is illustrated. Bit 11 comprises a bit body 13, which is threaded at its upper extent for connection into a drill string. At least one nozzle 15 is provided to discharge drilling fluid pumped from the drill string to the bottom of the borehole to cool bit 11 and carry away cuttings. A lubricant pressure compensator system 17 is carried by bit body 13 to reduce pressure differentials between drilling fluid in the borehole and the lubricant provided for each of the cutters and its associated bearing and seal.

A plurality of cutting elements 19 are arranged in circumferential rows on a plurality of, usually three, cutters 21, 23 (one of which is not shown in FIG. 1). Cutting elements 19 preferably are formed of a hard metal, such as sintered tungsten carbide, and are secured in apertures in cutters 21, 23 by interference fit. Cutters 21, 23 are frusto-conical and are mounted on cantilevered bearing shafts depending inwardly and downwardly from bit body 13. Each cutter 21, 23 includes a conical gage surface 31, which is adapted to contact the sidewall of the borehole during drilling operation. Each cutter 21, 23 also includes a cutter backface 33 at the base of the cutter, which is a surface generally perpendicular to the axis of the cutter.

A plurality of chisel-shaped inserts 41 are disposed in counterbores 43 in gage surface 31. As described in greater detail with reference to FIG. 4, gage cutting elements 41 engage and disintegrate the sidewall of the borehole. Counterbores 43 provide an area in which cuttings can move around cutting elements 41, permitting them to be flushed up the borehole by drilling fluid.

FIG. 2 is a plan view of the cutters of a conventionally offset earth-boring bit, viewed from above. The rotational axis of each cutter is offset, in the direction of rotation of the bit, a selected distance d from a parallel radial line intersecting the geometrical center C of the bit. With this positive offset, the gage surface of each cutter engages the sidewall of the borehole at a point forward (in the direction of rotation) of the rotational axis of each cutter. Thus, any gage cutting elements on the gage surfaces of positively offset cutters engage the sidewall of the borehole as the gage surface is turning downwardly into the corner of the borehole. Because the vertical component of the reaction force exerted by the formation material in opposition to the gage cutting elements is upward, the overall weight-on-bit is diminished, aggravating off-center running tendencies.

FIG. 3 is a schematic plan view of cutters 21, 23, 25 of the earth-boring bit according to the present invention, viewed from above. Each cutter 21, 23, 25 is provided with "negative" offset, in which the axes of rotation of the cutters are offset a selected distance d from a parallel radial line intersecting the geometric center C of bit 11 in a direction opposite that of the rotation of the bit. For a 7⅞ inch bit, the preferred offset is 3/16 inch. Provision of all cutters 21, 23, 25 with negative offset moves the cutters on a path skewed towards the center of the bit, which largely eliminates the tendency of positively offset cutters to run off-center, while maintaining the advantages of sliding induced by offset. Provision of cutters 21, 23, 25 with negative offset moves the point of contact of the gage surface of each cutter with the sidewall of the borehole behind the axis of rotation of cutters 21, 23, 25. Thus, the gage cutting elements (41 in FIG. 1) on the gage surface (31 in FIG. 1) will engage the sidewall of the borehole as the cutters turn upwardly with respect to the corner of the borehole. Because the vertical component of the reaction force exerted by the formation material in opposition to the gage cutting elements is downward, the overall weight-on-bit is increased, reducing off-center running tendencies.

FIG. 4 is an enlarged, fragmentary section view of cutter 21 of earth-boring bit 11 depicted in FIG. 1, and illustrates a preferred gage cutting structure. Chisel-shaped gage cutting elements 41 are secured by interference fit in a plurality of staggered counterbores 43 on gage surface 31. Chisel-shaped cutting elements 41 define a pair of flanks or surfaces 41A, which converge to define a crest 41B, which is aligned with the longitudinal axis of the cutting element. Gage cutting elements 41 project beyond gage surface 31 and are tilted toward cutter backface 33 such that an acute angle $\alpha$ is defined between the longitudinal axis and gage surface 31 of between 15 and 75 degrees. Chisel-shaped gage cutting elements 41 preferably are formed of cemented tungsten carbide in the configuration described in commonly assigned U.S. Pat. No. 5,351,768, Oct. 4, 1994, to Scott et al.

One of flanks 41A of chisel-shaped cutting element 41 is arranged to be a cutting surface having a negative rake angle (cutting surface leads crest or cutting edge 41B) and facing backface 33 of the cutter for engaging the sidewall of the borehole being drilled as the gage surface moves up the sidewall. This type of cutting structure is particularly adapted to the negative offset of cutters 21, 23, 95 and is referred to as "inverted" because of the orientation toward cutter backface 33.

The cutting surface may be formed of a super-hard material to increase its wear-resistance and to create a self-sharpening element. Furthermore, engagement between gage cutting elements 41 and the sidewall of the borehole on the upward rotation of each cutter 21, 23, 25 generates a downward force on bit 11, further increasing its ability to resist off-center running especially in light weight-on-bit drilling applications. Other gage cutting structure may be suitable, provided that a cutting surface is defined generally facing cutter backface 33 to engage the sidewall of the borehole during the upward rotation of gage surface 31.

A principal advantage of the present invention is that an earth-boring bit is provided that counteracts off-center running tendencies and associated low penetration rates and premature wear or failure of cutting structures and bearings.

The invention has been described with reference to a preferred embodiment thereof. It is thus not limited, but is susceptible to variation and modification without departing from the scope and spirit of the invention.

We claim:

1. An earth-boring bit comprising:

a bit body;

at least one cantilevered bearing shaft depending inwardly and downwardly from the bit body;

a cutter mounted for rotation on the bearing shaft and including a gage surface and an adjacent cutter backface, the cutter having a negative offset with respect to the axis and direction of rotation of the bit;

a plurality of cutting elements arranged on the cutter, including a plurality of gage cutting elements on the gage surface of the cutter, at least one of the gage cutting elements being chisel-shaped and having a crest and a longitudinal axis and projecting beyond the gage surface, the chisel-shaped element being tilted toward the cutter backface such that an acute angle of between 15 and 75 degrees is defined between the longitudinal axis and the gage surface, the chisel-shaped element defining a cutting surface facing the backface of the cutter for engaging the sidewall of the borehole being drilled as the gage cutting element moves up the sidewall.

2. The earth-boring bit according to claim 1 wherein the cutting surface of the gage cutting element defines a negative rake angle with respect to the sidewall of the borehole engaged by the gage cutting element.

3. The earth-boring bit according to claim 1 further comprising three cutters on three bearing shafts, each cutter having a negative offset with respect to the axis and direction of rotation of the bit and each cutter including chisel-shaped gage cutting elements tilted toward the cutter backface such that an acute angle of between 15 and 75 degrees is defined between the longitudinal axis and the gage surface.

4. The earth-boring bit according to claim 1 wherein the cutting elements are formed of cemented tungsten carbide interference fit into apertures in the cutter.

5. An earth-boring bit comprising:

a bit body;

a pair of cantilevered bearing shafts depending inwardly and downwardly from the bit body;

a cutter mounted for rotation on each bearing shaft and including a gage surface and a cutter backface, each bearing shaft and cutter having a negative offset with respect to the axis and direction of rotation of the bit;

a plurality of cutting elements arranged on the cutter, including a plurality of gage cutting elements on the gage surface of the cutter, at least one of the gage cutting elements being chisel-shaped and defining a crest and a longitudinal axis, the chisel-shaped insert being tilted toward the cutter backface such that an acute angle of between 15 and 75 degrees is defined between the longitudinal axis and the gage surface.

6. The earth-boring bit according to claim 5 further comprising three cutters on three bearing shafts, each cutter having a negative offset with respect to the axis and direction of rotation of the bit each cutter including chisel-shaped gage cutting elements tilted toward the cutter backface such that an acute angle of between 15 and 75 degrees is defined between the longitudinal axis and the gage surface.

7. The earth-boring bit according to claim 5 wherein the cutting elements are formed of cemented tungsten carbide interference fit into apertures in the cutter.

8. An earth-boring bit comprising:

a bit body;

at least a pair of cantilevered bearing shafts depending inwardly and downwardly from the bit body;

a cutter mounted for rotation on each bearing shaft and including a gage surface and an adjacent cutter backface, the bearing shaft and cutter having a negative offset with respect to the axis and direction of rotation of the bit;

a plurality of cutting elements arranged on the cutter, including a plurality of gage cutting elements on the gage surface of the cutter, at least one of the gage cutting elements projecting beyond the gage surface and defining a cutting surface facing the backface of the cutter for engaging the sidewall of the borehole being drilled as the gage cutting element moves up the sidewall.

9. The earth-boring bit according to claim 8 wherein the cutting surface of the gage cutting element defines a negative rake angle with respect to the sidewall of the borehole engaged by the gage cutting element.

10. The earth-boring bit according to claim 8 wherein the at least one gage cutting element projecting beyond the gage surface is chisel-shaped and defines a crest and a longitudinal axis, the chisel-shaped insert being tilted toward the cutter backface such that an acute angle of between 15 and 75 degrees is defined between the longitudinal axis and the gage surface.

11. The earth-boring bit according to claim 8 further comprising three cutters on three bearing shafts, each cutter having a negative offset with respect to the axis and direction of rotation of the bit and each cutter including chisel-shaped gage cutting elements tilted toward the cutter backface such that an acute angle of between 15 and 75 degrees is defined between the longitudinal axis and the gage surface.

12. The earth-boring bit according to claim 8 wherein the cutting elements are formed of cemented tungsten carbide interference fit into apertures in the cutter.

* * * * *